United States Patent [19]

Ramage et al.

[11] Patent Number: 4,839,024

[45] Date of Patent: Jun. 13, 1989

[54] SPLIT-FEED NAPHTHA REFORMING PROCESS

[75] Inventors: Michael P. Ramage, Moorestown, N.J.; Donald C. Wong, New York, N.Y.

[73] Assignee: Mobil Oil Corporation, New York, N.Y.

[21] Appl. No.: 95,489

[22] Filed: Sep. 10, 1987

[51] Int. Cl.[4] ..... C10G 35/04

[52] U.S. Cl. ..... 208/64

[58] Field of Search ..... 208/64

[56] References Cited

U.S. PATENT DOCUMENTS 3,753,891 8/1973 Graven et al. ..... 208/65
4,134,823 1/1979 Bertolacini et al. ..... 208/65
4,401,554 8/1983 Choi et al. ..... 208/64
4,594,145 6/1986 Roarty ..... 208/138

*Primary Examiner*—Curtis R. Davis
*Attorney, Agent, or Firm*—Alexander J. McKillop; Charles J. Speciale; Malcolm D. Kean

[57] ABSTRACT

A naphtha feedstock is reformed by splitting the feedstock into a first $C_6$ or lower fraction and a $C_7$ and higher fraction, and passing the $C_6$ and lower fraction to a reactor and combining the effluent from the first reactor with the $C_7$ and higher fraction and passing the mixture to a second reactor. The reformate produced has an octane rating at least equivalent to that produced by conventional processes, but has a lowered benzene content.

12 Claims, 1 Drawing Sheet

SPLIT-FEED NAPHTHA REFORMING PROCESS

BACKGROUND OF THE INVENTION

1. Field of the Invention

This invention relates to a process for the reforming of naphtha intended for use as automobile fuel.

2. Discussion of the Prior Art

As is well known, automobile fuel or gasoline is derived from crude oil. The naphtha fraction boiling at about 175° to 445° C. obtained from crude oil by distillation is called straight-run or virgin naphtha. Such naphtha has a low octane rating, and its octane rating must be increased before it can be used as the gasoline of commerce.

According to conventional practice, the octane rating of straight-run naphtha is increased by catalytic reforming. In a typical reforming process, the naphtha heated to about 780°-1000° F. is contacted with a reforming catalyst, such as platinum on alumina. Since the reaction involved in reforming are endothermic, reforming is best effected in a series of reactors with the naphtha being pre-heated prior to passage to each reactor.

As is well known, a variety of reactions occur during reforming. The compounds contained in the naphtha, mainly hydrocarbons, are isomerized to more highly branched compounds or are converted to cyclic compounds. Cycloparaffins (naphthenes) are dehydrogenated to aromatic compounds, mainly benzene, toluene and xylene (BTX). The amount and distribution of the aromatic compounds produced varies considerably depending on the nature of the naphtha feedstock and the reforming conditions utilized. On average, catalytic reforming yields a reformate containing about 8% by weight of benzene, about 10% by weight of toluene, and about 15% by weight of xylene and ethylbenzene.

In recent years, benzene has been recognized as being a carcinogen, and the desirability of reducing exposure to benzene has become apparent. Accordingly, it is an object of the present invention to provide an improved reforming process which produces gasoline having an acceptable octane rating, but a lowered content of benzene.

SUMMARY OF THE INVENTION

It has been discovered that the benzene content of the reformate produced by catalytic reforming can be lowered without sacrifice of octane rating by splitting the naphtha feed prior to reforming and passing only the $C_6$ and lower fraction to the first reactor in a sequence of reforming reactors.

More specifically, the present invention is a process for reforming a naphtha feed which comprises splitting the naphtha into a $C_6$ and lower fraction and a $C_7$ and higher fraction, feeding the $C_6$ and lower fraction to a first reforming reactor under reforming conditions, combining effluent from the first reforming reactor with the $C_7$ and higher fraction to form a combined stream, feeding the combined stream to a second reforming reactor, and withdrawing effluent from the second reforming reactor. In a preferred embodiment of the invention, the temperature in the first reactor is lower than the temperature in the second reactor. In another preferred embodiment, the effluent from the second reforming reactor is passed to a third reforming reactor, and effluent is withdrawn from the third reforming reactor. In yet another preferred embodiment, a fourth reforming reactor is utilized, and the effluent from the third reactor is passed to the fourth reactor. The product reformate is the effluent from the last reforming reactor in the sequence of reforming reactors utilized.

At the same time the benzene content of the reformate is being reduced, the toluene and higher aromatic content of the reformate is increased. Further, the process of the present invention has the added and unexpected advantage of increasing the total yield of $C_5$ and higher reformate.

DETAILED DESCRIPTION OF THE INVENTION

Figure 1:
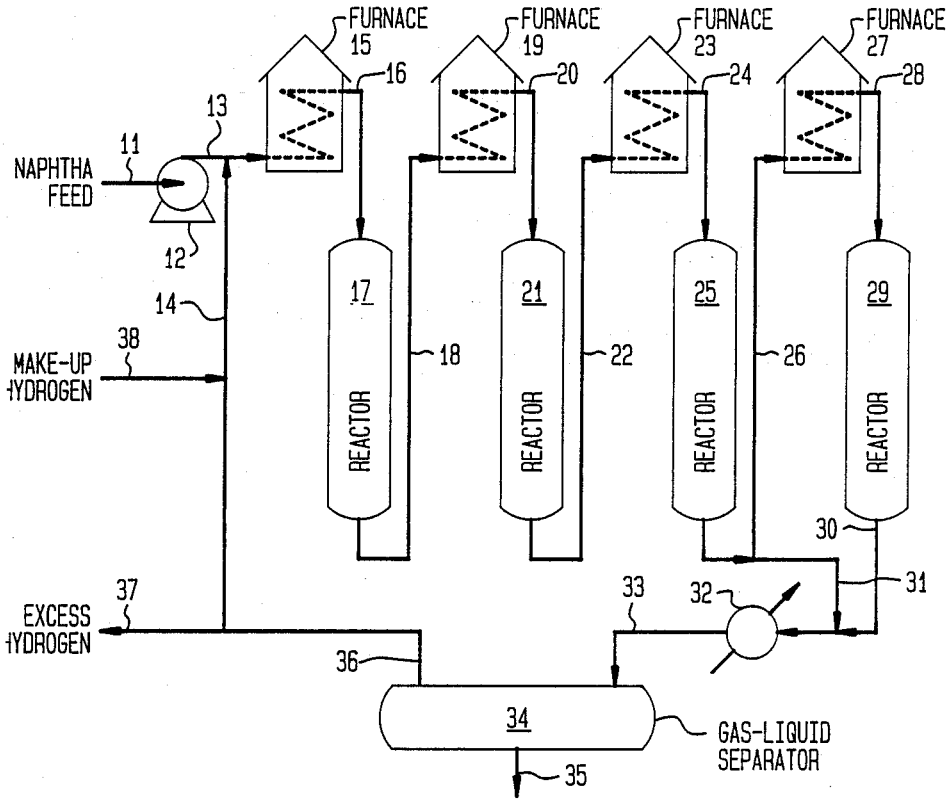
FIG. 1 is a flow sheet illustrating operation of a conventional reforming process utilizing three or four reforming reactors in sequence.

As illustrated in FIG. 1, in a conventional reforming process, straight-run naphtha having a boiling range of about 175° F. to about 450° F., is passed through line 11 into pump 12, which pumps the naphtha through line 13. Hydrogen-containing recycle gas is introduced into line 13 via line 14 to form a mixture with the hydrocarbons in line 13. The resulting mixture is passed to furnace 15 and preheated to about 950° F., and the preheated mixture is passed via line 16 to reactor 17.

The effluent from reactor 17 is passed via line 18 to furnace 19 and pre-heated to about 950° F. and passed via line 20 to reactor 21.

The effluent from reactor 21 is passed via line 22 to furnace 23 and pre-heated to about 950°09 F. and passed via line 24 to reactor 25.

When a fourth reforming reactor is utilized, the effluent from reactor 25 is passed via line 26 to furnace 27 and pre-heated to about 950° F. and passed via line 28 to reactor 29.

Reactors 17, 21, 25 and 29 are all conventional reforming reactors containing a catalyst comprising about 0.1 to about 2% by weight of platinum supported on catalytically active alumina. The pressure in each reactor is about 150 psig to about 400 psig.

The effluent from reactor 25 or from reactor 29 is passed through line 30 or line 31, respectively, to cooler 32, and then via line 33 to gas-liquid separator 34 operated at a pressure of about 100 psig to about 320 psig and at temperature of about 100° F. Liquid product or reformate is removed from the separator via line 35. Reforming is a net producer of hydrogen, and gaseous material comprising hydrogen and low-boiling hydrocarbons is removed from separator 34 via line 36. A portion of that hydrogen-hydrocarbon gas is recycled via line 14 and excess hydrogen is withdrawn via line 37 for use elsewhere in the plant. During start-up or when otherwise required, make-up hydrogen gas may be introduced into the system via line 38.

Figure 2:
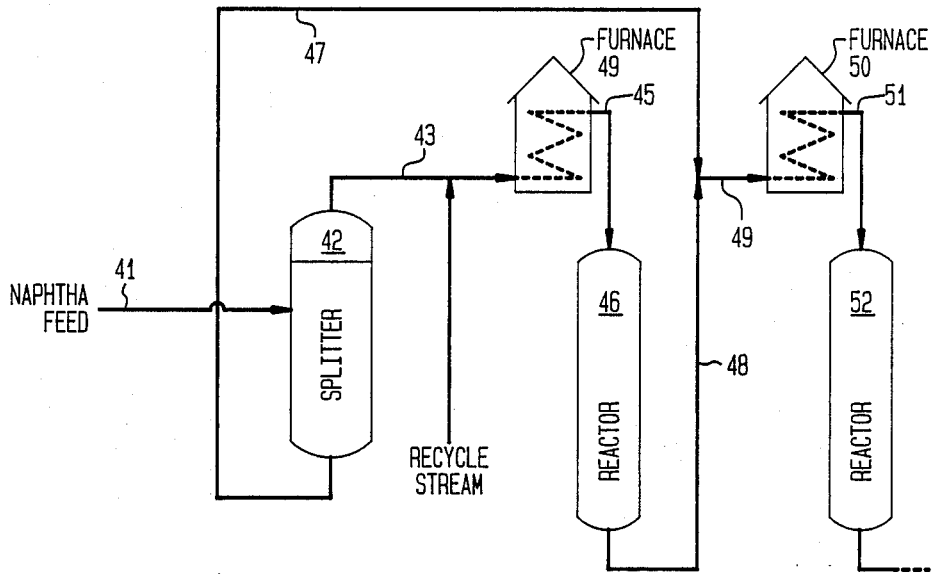
FIG. 2 is a flow sheet illustrating operation of a split-feed reforming process according to the present invention.

Referring to FIG. 2, in the process of the present invention straight-run naptha is fed via line 41 into splitter 42 wherein the $C_7$ and higher fraction is separated from the $C_6$ and lower fraction. The $C_6$ and lower fraction, is passed via line 43 to furnace 44 and then via line 45 to reactor 46 and reformed in the usual manner. The $C_7$ and higher fraction in line 47 is combined with the effluent in line 48 from reactor 46. The combined effluent from reactor 46 and $C_7$ and higher fraction are passed via line 49 to furnace 50 and then via line 51 to reactor 52. The effluent from reactor 52, after pre-heating, is passed to a third reactor (not shown) and the effluent from the third reactor is processed in a manner similar to that illustrated in FIG. 1.

The data tabulated below was obtained with Beryl naphtha at 300 psig and $100_5$+R+O octane in a kinetic model simulation using three reforming reactors in sequence. In Run 1 the naphtha feed was not split before it was passed to the reforming reactors as shown in FIG. 1. In Runs 2–5 the naphtha was split before it was passed to the reforming reactors as shown in FIG. 2. In Runs 3, 4 and 5 the temperature in the first reforming reactor was about 150°–200° F. lower than that in the second and third reforming reactors. The reaction conditions used and the results obtained are as follows:

| Run No. | 1 | 2 | 3 | 4 | 5 |
|---|---|---|---|---|---|
| Inlet Temp. °F. | | | | | |
| 1st Reactor | 919 | 962 | 792 | 790 | 785 |
| 2nd Reactor | 919 | 962 | 982 | 980 | 975 |
| 3rd Reactor | 919 | 962 | 982 | 980 | 975 |
| Naphtha Split | No | Yes | Yes | Yes | Yes |
| Benzene Yield | | | | | |
| Vol % | 6.8 | 6.3 | 5.8 | 4.9 | 5.9 |
| Wt. % | 8.0 | 7.3 | 6.7 | 5.7 | 6.9 |
| $IC_6$ Yield | | | | | |
| Vol % | 7.7 | 8.3 | 8.8 | 9.2 | 8.8 |
| Wt. % | 6.8 | 7.3 | 7.7 | 8.0 | 7.7 |
| $C_5$+ Yield | | | | | |
| Vol. % | 77.2 | 77.8 | 78.7 | 78.5 | 78.0 |

The data tabulated below was obtained with Beryl naphtha at 300 psig and 100 $C_5$+R+O octane in a kinetic model simulation using four reforming reactors in sequence as described above. In Runs 6 and 7, the temperature in the first reforming reactor was substantially lower than that in the second, third and fourth reforming reactors, but the naphtha feed was not split before it was passed to the reforming reactors as shown in FIG. 1. In Runs 8, 9 and 10 the temperature in the first reforming reactor was substantially lower than that in the second, third and fourth reforming reactors, and the naphtha feed was split before it was passed to the reforming reactors as shown in FIG. 2.

| Run No. | 6 | 7 | 8 | 9 | 10 |
|---|---|---|---|---|---|
| Inlet Temp. °F. | | | | | |
| 1st Reactor | 767 | 727 | 744 | 744 | 745 |
| 2nd Reactor | 917 | 922 | 944 | 934 | 935 |
| 3rd Reactor | 917 | 922 | 944 | 934 | 935 |
| 4th Reactor | 917 | 922 | 944 | 934 | 935 |
| Naphtha Split | No | No | Yes | Yes | Yes |
| Benzene Yield | | | | | |
| Vol. % | 6.7 | 6.5 | 6.0 | 5.2 | 6.2 |
| wt. % | 7.8 | 7.6 | 7.0 | 6.1 | 7.2 |
| $IC_6$ Yield | | | | | |
| Vol. % | 7.8 | 7.9 | 8.8 | 9.2 | 8.7 |
| wt. % | 6.8 | 6.9 | 7.7 | 8.0 | 7.6 |
| $C_5$+ Yield | | | | | |
| Vol. % | 76.8 | 76.5 | 77.9 | 77.9 | 78.2 |

It is apparent from the results summarized in the tables above, that separating the naphtha feed into a $C_6$ and lower boiling fraction and a $C_7$ and higher boiling fraction, and feeding the lower boiling fraction to the first reactor and the higher boiling fraction to the second reactor, results in lowering the amount of benzene produced as well as increasing the $C_5$ and higher yield of the reformate at constant $C_5$+R+O octane.

As indicated earlier, catalytic reforming is customarily effected at temperatures in the range of about 780°–1000° F. As illustrated in the table above, superior results are obtained in the process of the present invention when the temperature in the first reactor is lower than the temperature in the second reactor. Preferably the temperature of the naphtha being fed to the first reactor should be at the lower end of the 780°–1000° F. range, preferably at about 780°–800° F., and preferably about 150°–200° F. lower than that being fed to the second reactor. However, the precise amount of the temperature differential is not critical to the advantageous operation of the process of the present invention. The amount of benzene produced would be diminished and the $C_5$ and higher yield of the reformate would be increased even if there were no temperature differential between the first and second reactors, provided that the naphtha feed is split as described herein.

What is claimed is:

1. A process for reforming a naphtha feed which comprises splitting the naphtha feed into a $C_6$ and lower fraction had a $C_7$ and higher fraction, feeding the $C_6$ and lower fraction to a first reforming reactor and into contact with a reforming catalyst under reforming conditions, combining the effluent from the first reforming reactor with the $C_7$ and higher fraction to form a combined stream, and feeding the combined stream to a second reforming reactor into contact with a reforming catalyst, and recovering an effluent from the second reforming reactor.

2. A process according to claim 1, wherein the $C_6$ and lower fraction is preheated before it is fed to the first reforming reactor and the combined stream is preheated before it is fed to the second reforming reactor.

3. A process according to claim 1, further comprising passing the effluent from the second reforming reactor to a third reforming reactor under reforming conditions, and recovering a reduced benzene-containing effluent from the third reactor.

4. A process according to claim 1, wherein the effluent from the second reactor is preheated before it is passed to the third reforming reactor.

5. A process according to claim 3, further comprising passing the effluent from the third reforming reactor to a fourth reforming reactor under reforming conditions, and recovering a reduced benzene-containing effluent from the fourth reactor.

6. A process according to claim 5, wherein the effluent from the third reactor is preheated before it is passed to the fourth reactor.

7. A process according to claim 1, wherein the temperature of the $C_6$ and lower fraction being fed to the first reactor is lower than that of the combined stream being fed to the second reactor.

8. A process according to claim 7, wherein the temperature difference between the $C_6$ and lower fraction being fed to the first reactor and the combined stream being fed to the second reactor is about 150°–200° F.

9. A method according to claim 8, wherein the temperature of the $C_6$ and lower fraction being fed to the first reactor is about 780°–800° F.

10. In a method for the catalytic reforming of a naphtha feedstock to produce a gasoline fuel utilizing a series of reforming reactors, the improvement which comprises:

splitting the naphtha feed to a $C_6$ and lower fraction had a $C_7$ and higher fraction, and feeding the $C_6$ and lower fraction to a first reforming reactor, recovering an effluent therefrom, combining the effluent with the $C_7$ and higher fraction and feeding said combined effluent and the $C_7$ and higher fraction to a second reforming reactor into contact with a reforming catalyst.

11. A method according to claim 10, wherein the temperature of the $C_6$ and lower fraction being fed to the first reforming reactor is lower than the temperature of the effluent and $C_7$ and higher fraction being fed to the second reforming reactor.

12. A method according to claim 11, wherein the temperature of the $C_6$ and lower fraction being fed to the first reforming reactor is about 780°–800° F.

* * * * *